US007441722B2

(12) United States Patent
Mancuso et al.

(10) Patent No.: US 7,441,722 B2
(45) Date of Patent: Oct. 28, 2008

(54) COIL REEL HOLD-DOWN DEVICE

(75) Inventors: Anthony J. Mancuso, 240 Quail Hollow La., E. Amherst, NY (US) 14051; Kevin Gerace, Attica, NY (US)

(73) Assignee: Anthony J. Mancuso, Clarence Center, NY (US)

( * ) Notice: Subject to any disclaimer, the term of this patent is extended or adjusted under 35 U.S.C. 154(b) by 1129 days.

(21) Appl. No.: 09/954,766

(22) Filed: Sep. 18, 2001

(65) Prior Publication Data

US 2003/0052211 A1 Mar. 20, 2003

(51) Int. Cl.
*B65H 23/08* (2006.01)

(52) U.S. Cl. ..... 242/422.5; 242/541.5; 242/547; 242/566

(58) Field of Classification Search ..... 242/422.5, 242/566, 547, 541.5, 541.6, 156.1
See application file for complete search history.

(56) References Cited

U.S. PATENT DOCUMENTS 2,416,585 A * 2/1947 Holub ..... 242/422.5
2,523,571 A 9/1950 Humm, Jr.
3,635,417 A * 1/1972 Kajiwara et al. ..... 242/562
3,767,133 A * 10/1973 Seo ..... 242/562.1
4,249,705 A 2/1981 Brooks et al.
4,290,563 A 9/1981 Brooks et al.
4,589,605 A 5/1986 Orii
4,610,408 A 9/1986 Box et al.
5,279,472 A * 1/1994 Hongo et al. ..... 242/422.5
5,330,119 A 7/1994 Rodriguez et al.
5,472,153 A 12/1995 Crowley et al.
5,518,199 A * 5/1996 Welp et al. ..... 242/541.6
5,803,393 A 9/1998 Julian
6,119,971 A 9/2000 Jones
6,547,909 B1 * 4/2003 Butterworth ..... 156/157
6,691,945 B2 * 2/2004 Slezak ..... 242/564

FOREIGN PATENT DOCUMENTS

JP 63-17755 * 1/1988 ..... 242/422.5

* cited by examiner

*Primary Examiner*—William A Rivera
(74) *Attorney, Agent, or Firm*—Simpson & Simpson, PLLC

(57) ABSTRACT

The present invention generally includes a coil reel hold-down device having a base plate operatively arranged to be secured to a floor and a snubber arm pivotably mounted to the base plate, the snubber arm having a first section and a second section disposed at an obtuse angle with respect to one another, and a means for effecting a pivoting movement of the snubber arm relative to the base plate.

9 Claims, 9 Drawing Sheets

COIL REEL HOLD-DOWN DEVICE

FIELD OF THE INVENTION

This invention relates generally to a method and apparatus to facilitate production in the metal stamping industry, and more specifically for use in conjunction with the safe unbounding of material bound on a payoff reel.

BACKGROUND OF THE INVENTION

Many industrial operations require the use of a sheet metal strip payout device in which coil reels of wound strip material are disposed on a rotatable platform in order to unwind or payout the strip for feeding to a processing station, such as, a stamping press or similar metal forming machines. The steel wire or flat stock is stored on pay-off reels or spools until needed, at which time strip decoilers or metal strip payout devices automatically uncoil and feed coiled wire or flat stock to the presses. The coiled steel is under high tension and is held in place on the pay-reels by holding bands.

Before the stock can be fed from the coil reel to the presses, the holding bands must be cut. Cutting the steel bands to release the coiled material is referred to an "unbounding." When the coiled material is unbounded, if unchecked, it uncoils in a violent spring-like way placing the machine operator, other nearby employees and other machinery in danger of being struck by the uncontrolled unwinding of the coil.

Sheet metal strip-feeding apparatus having holding arms to safely hold the bound material while it is being unbound are known in the art. One such device is disclosed in U.S. Pat. No. 4,610,408 (Box et al). The apparatus described in this patent was designed to feed strip material from a wound coil to a work processing station. This apparatus is adapted for mounting a spool of coiled material onto a turntable and controlling the rotational speed of the turntable so that the wound strip material is fed to a strip processing station at regulated rates. Additionally, the apparatus is equipped with a snubber arm that is adapted to bear on the exterior of the strip coil under the urging of a constant pressure fluid cylinder. The snubber arm is a safety device to keep the wound material from "springing" out at nearby workers or machinery when the coil is unbounded. This safety device however, is of no use to any pre-existing, free-standing feeding apparatus except to the one of which it is part.

Orii, in U.S. Pat. No. 4,589,605, provides a coiled material looping apparatus designed to shorten the length of the primary process line of a pressing machine. To hold down the coiled material, this apparatus is equipped with a coil holding member having a roller on one end and a cylinder, operated by a pressure medium, at the other end. The cylinder exerts pressure on the roller part of the coil holding member enabling it to keep the coiled material from unwinding prematurely. However, only those having a need for such a specific use machine would be able to avail themselves of the protection provided by the hold-down that is an integral part of this invention.

An apparatus for simultaneously preparing and feeding multiple coils of strip stock into a strip processing line is disclosed by Rodriguez et al. in U.S. Pat. No. 5,330,119. This device is also equipped with coil support mechanisms that function to prevent a coil from unrestrained uncoiling. However, as this apparatus was designed to simultaneously handle multiple coils, it is necessarily complex and thus, expensive. Here too, the safety precautions provided by the hold-down of this device is available only with this device.

Thus, to take advantage of the hold-down devices that are now in the art, entire uncoiling/feed units would have to be purchased, as the hold-down mechanisms of these devices are available only as expensive accessories for their related unit, or as add-on options that can be attached only to the reel unit for which they were designed.

Clearly, there is an unmet and longfelt need for a free-standing, cost effective, hold-down device that will control the tension in coiled material as the coil reel is being unbounded. Ideally, such a hold-down would be compatible with a variety of existing uncoil/feeder models, and especially with coil reel models that do not include a hold-down mechanism in their original design.

SUMMARY OF THE INVENTION

The present invention generally comprises a coil reel hold-down device. In one embodiment, the device includes a base plate operatively arranged to be secured to a floor and a snubber arm, which is pivotably mounted to the base plate. The snubber arm includes a first section and a second section disposed at an obtuse angle with respect to one another. The device further includes a means for effecting a pivoting movement of the snubber arm relative to the base be plate. A hold-down mechanism is secured to the distal end of the second arm section. In operation, the snubber arm is pivoted toward a coil reel until the hold-down mechanism contacts the coil, thereby holding the coil in place when securing bands about the coil are removed.

The invention in its broadest aspect comprises an apparatus for safely dispensing various flexible strands of coiled materials such as sheet metal material, wire, cable and the like.

A general object of the present invention is to safely facilitate production in the metal stamping industry.

Another object of the present invention is to control the tension in a coil throughout the unbounding procedure.

Still another object of the present invention is to provide a coil reel hold-down device which is free standing and operatively arranged to be retrofitted to function in combination with any of thousands, if not tens of thousands, of pre-existing standalone coil reels in industry.

Still a further object of the present invention is to provide a coil reel hold down device that can be quickly and easily adapted for use in conjunction with a wide variety of differently sized spools and wire materials.

These and other objects, features and advantages of the present invention will become readily apparent to those having ordinary skill in the art upon a reading of the following detailed description in view of the appended claims and drawings.

DETAILED DESCRIPTION OF THE PREFERRED EMBODIMENT

Figure 1:
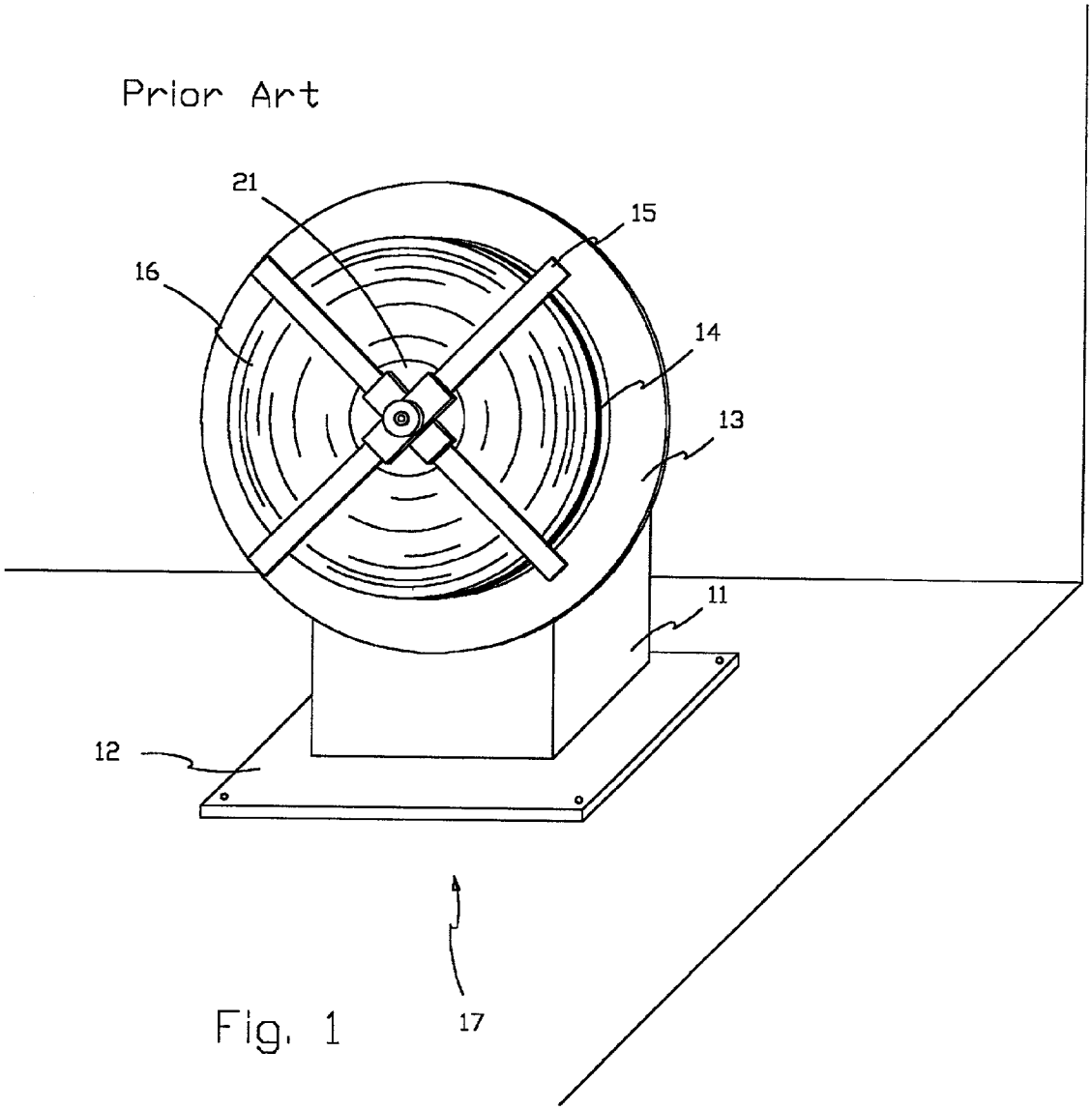
FIG. 1 is a perspective view of a prior art free-standing bounded reel of coiled material rotatably mounted on a metal strip payout device.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Figure 2:
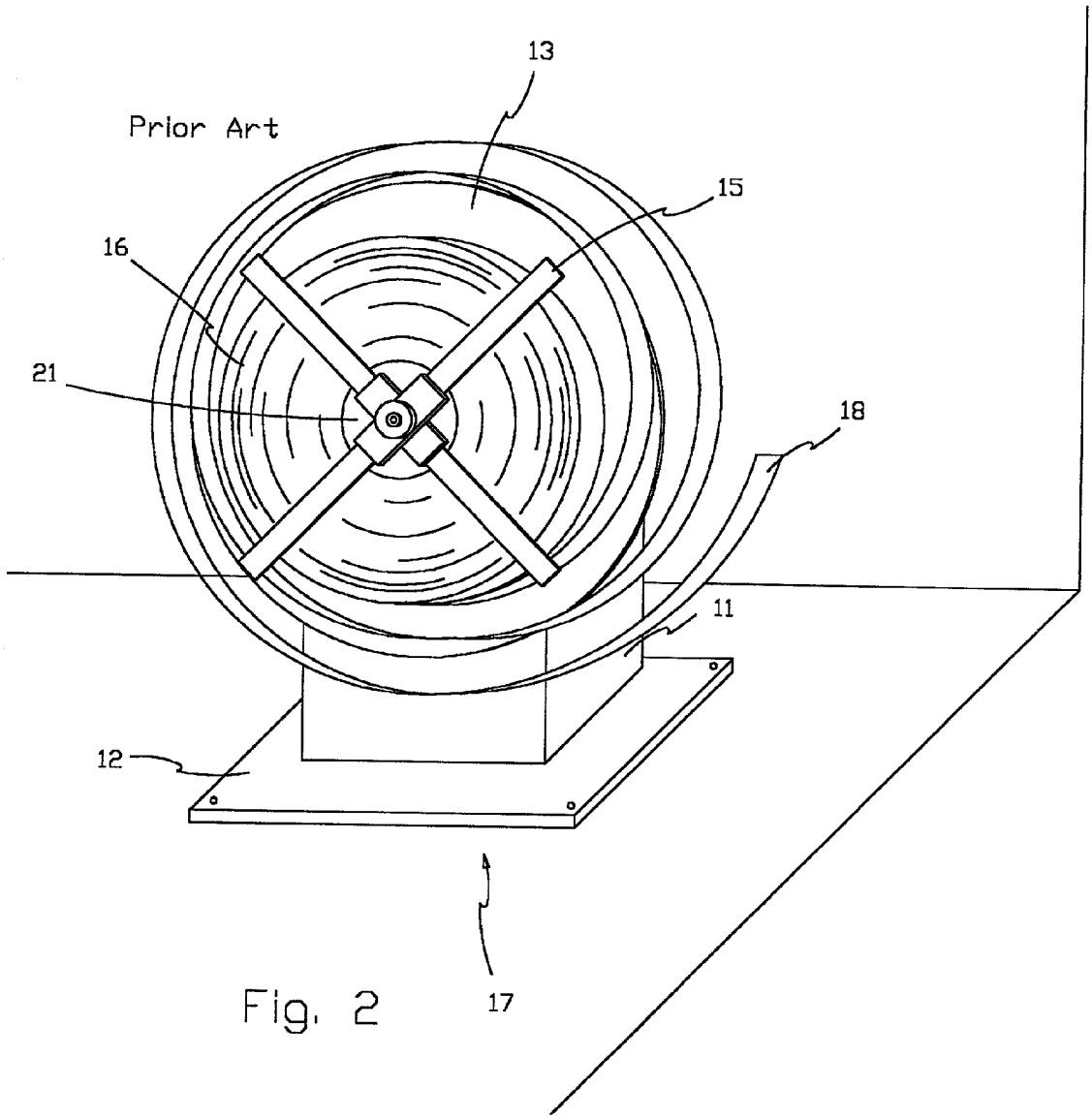
FIG. 2 is a perspective view of the prior art reel and device shown in FIG. 1, illustrating uncontrolled unbounding of the coil material when securing bands are removed.

Adverting now to the drawings, FIG. 1 illustrates coil reel 16, a bounded reel of coiled material, rotatably mounted on prior art free standing metal strip payout device 17. Currently in the manufacturing industry there are thousands, if not tens of thousands, of pre-existing metal strip payout devices. These payout devices store coils of metal strip material for feeding to metal forming and fabricating devices, such as cutters, benders, and the like (referred to herein as "processing stations"). A problem in the industry is that of unbounding the coils and then feeding the metal strip material to the forming/fabricating devices. There has been a long felt and serious safety problem associated with the current unbounding procedure. Coil reel 16 is under high tension and is held in place on spool 21 by reel band 14 (as shown in FIG. 1). Before the coiled material can be fed from the metal strip payout device 17, reel band 14 must be cut. (This process is referred to as "unbounding.") When wound strip material 18 is unbounded it uncontrollably and rapidly uncoils in a violent spring-like manner as illustrated in FIG. 2. In the unbounding procedure, a lethal force is set free that jeopardizes machine and personnel as the potential energy of the bound coil is converted to kinetic energy. Others have solved the problem by replacing existing metal strip pay out devices with new machines which include an integral snubber arm that holds the coil in place during unbounding. This is an expensive alternative, however, in that it requires the purchase of new machinery as opposed to remedying the problem for the thousands of stand-alone devices currently in place.

The coil reel hold down device of the present invention uniquely solves the problem in a way not contemplated by the prior art. The current invention makes use of and does not require structural changes in existing machines. The coil reel hold down device of the present invention provides a safe and economical utilization of the thousands of existing machines that would otherwise be disposed of or otherwise not used or remedied.

Figure 3:
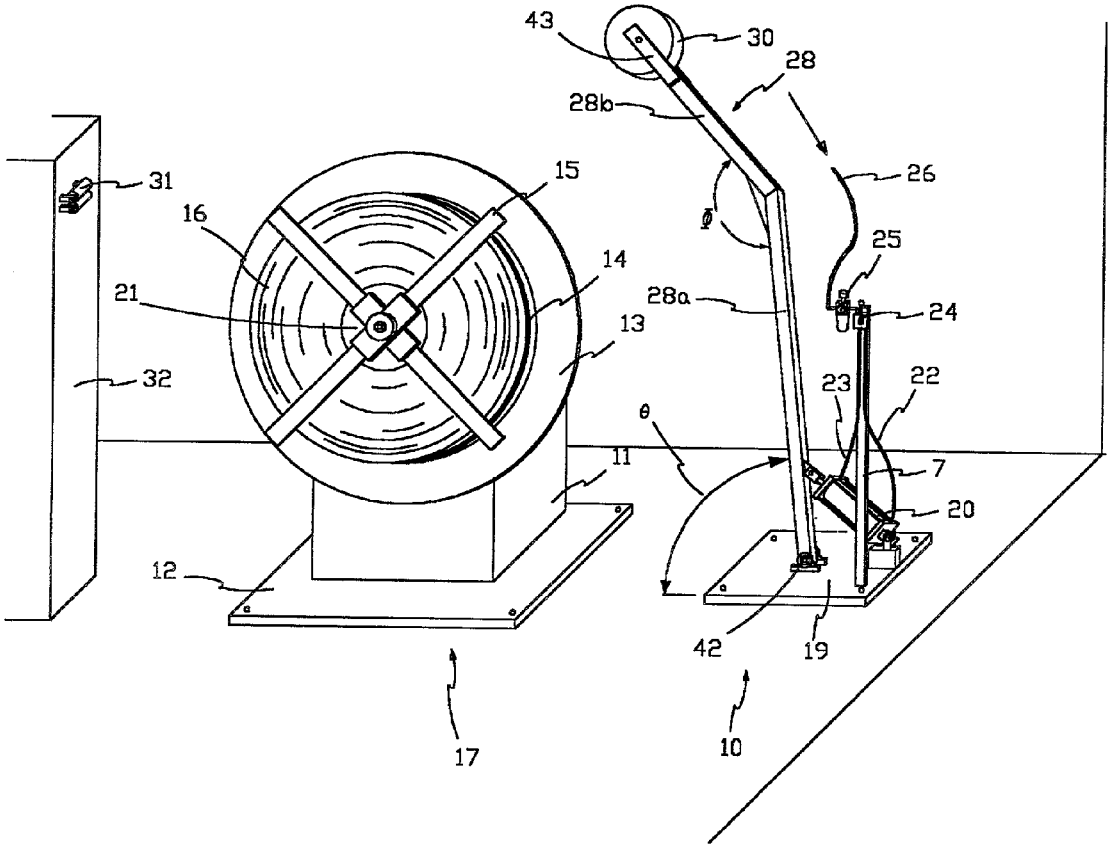
FIG. 3 is a perspective view of the present invention shown mounted proximate the prior art coil reel shown in FIGS. 1 and 2.

FIG. 3 illustrates a preferred embodiment of the present invention. Coil reel hold-down device 10 is intended for use in an industrial environment in conjunction with metal strip payout device 17 and processing station 32. Coil reel 16 is a coil of wound strip material 18 (as shown in FIG. 2), such as wire or flat metal stock, rotatably disposed on metal strip payout device 17 to facilitate the payout of the wound strip material to processing station 32 (a stamping press, cutting or bending device, or similar metal forming machine).

Figure 4:
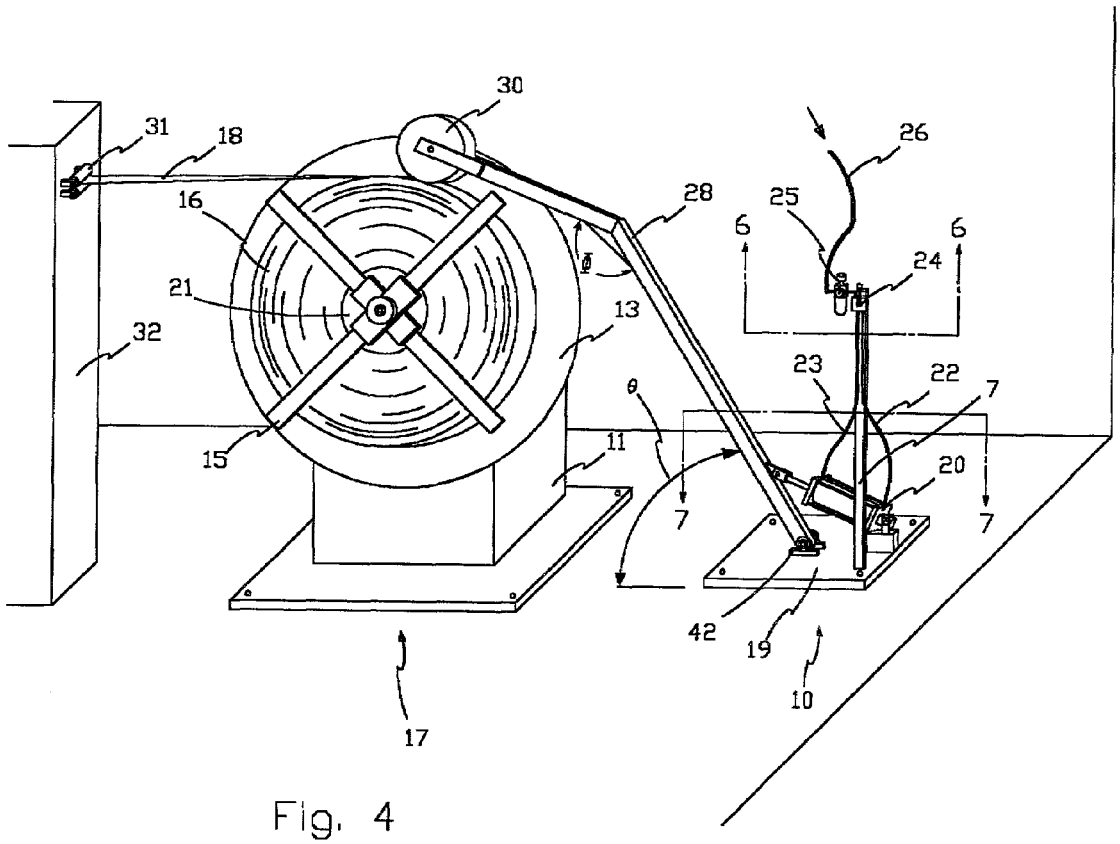
FIG. 4 is a perspective view of the present invention similar to the view of FIG. 3, except showing the snubber arm of the invention in place holding down a coil.

In a preferred embodiment of the present invention, as shown in FIGS. 3 and 4, coil reel hold down device 10 includes base plate 19 arranged to be mounted to a shop floor and snubber arm 28 pivotably attached to base plate 19 by snubber arm mounting assembly 42. Snubber arm 28 generally comprises first section 28A and second section 28B disposed at an obtuse angle of about 120 degrees with respect to one another. (It should be appreciated that other obtuse angles, other than approximately 120 degrees, would also be suitable.) In one embodiment, snubber wheel 30 is rotatably attached to end 43 of Snubber arm 28. Snubber wheel 30 is adapted to bear on the exterior of the coil reel under the urging of a constant pressure exerted by cylinder/piston 20 (in a preferred embodiment, a five inch pneumatic cylinder was used, although hydraulic cylinders and other length cylinders could also be used). In a preferred embodiment, the snubber wheel is operatively arranged to rotate and then apply approximately 600 psi to the coil to facilitate controlled unwinding without releasing tension. It should be appreciated that the snubber wheel can comprise any means well known in the art to maintain pressure on coil reel 16, such as a roller or even a slidable surface (such as a slider coated with silicone, for example).

Figure 5:
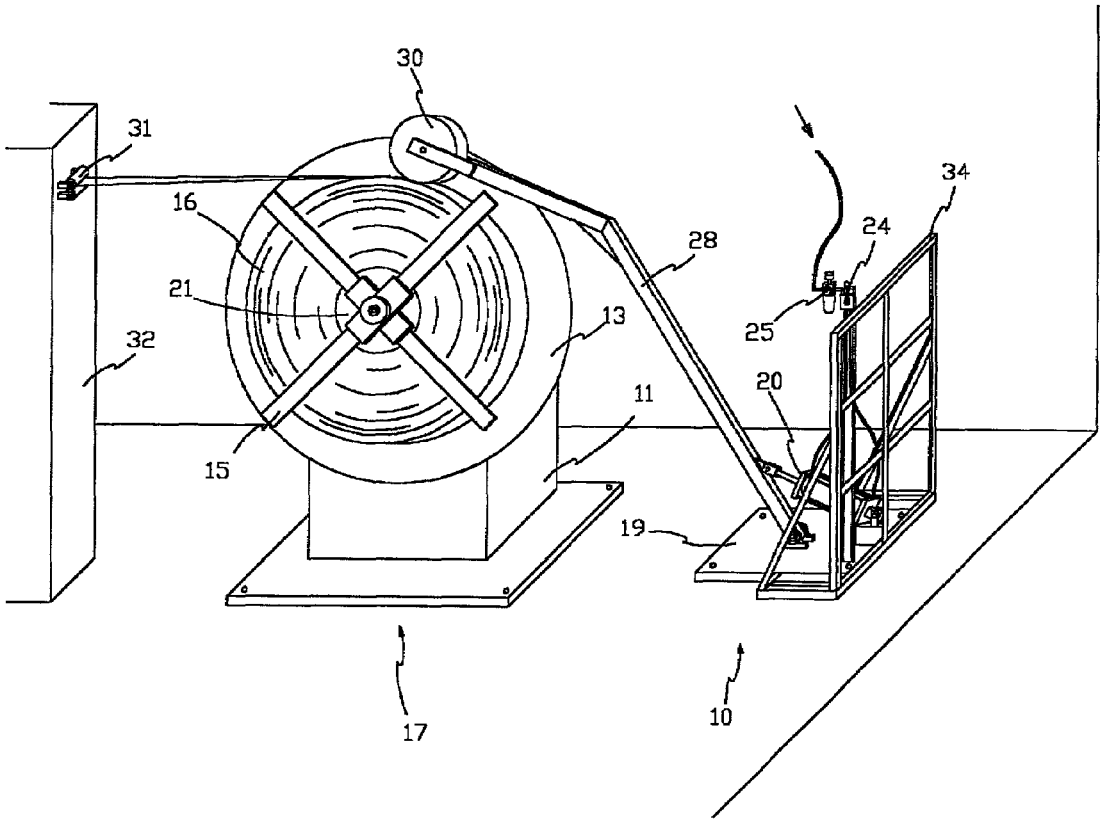
FIG. 5 is a perspective view of the present invention similar to the view of FIG. 4 except showing an additional personnel guard arranged proximate the present invention.

FIG. 5 is a perspective view of the invention which illustrates personnel guard 34 arranged proximate coil reel hold-down device 10. Personnel guard 34 is comprised of a matrix of metal members that form a shield and is positioned so that a person can operate coil reel hold-down device 10 from behind the personnel guard. Personnel guard 34 can comprise any structure suitably configured and constructed to protect the operator from uncontrolled material in the unbounding process or defective equipment and the like.

Figure 7:
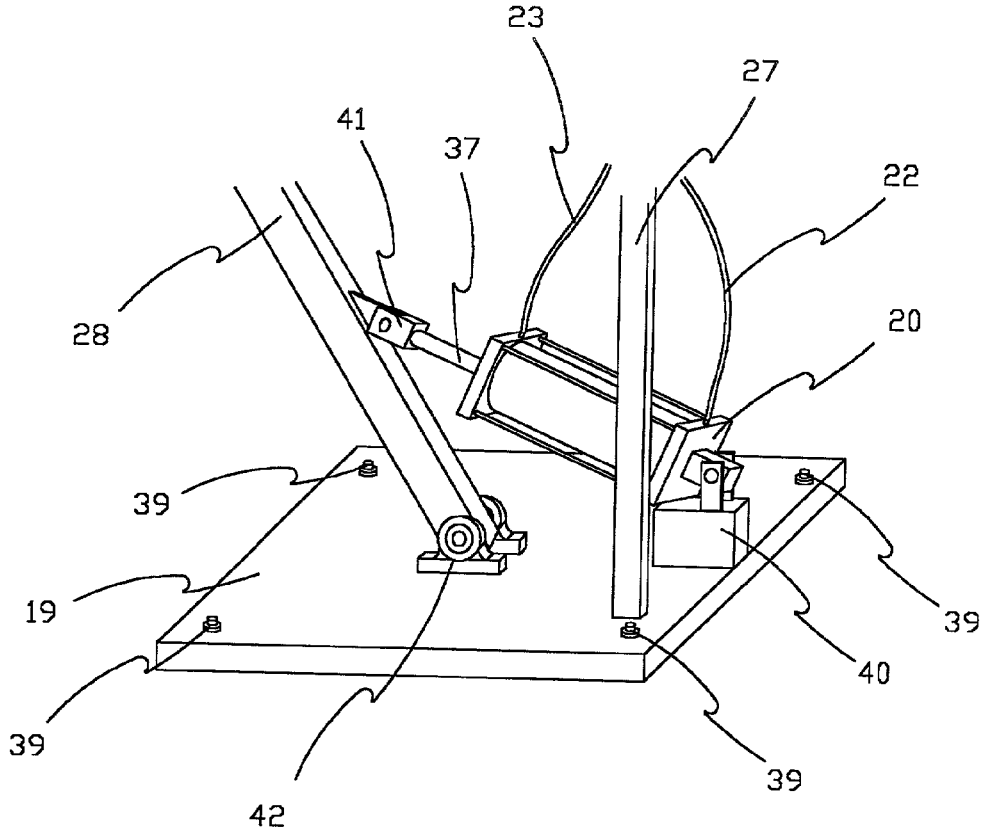
FIG. 7 is an enlarged perspective view of the air cylinder/piston assembly of the present invention taken generally along line 7-7 in FIG. 4.

FIG. 7 is an enlarged perspective view of cylinder/piston assembly 20 taken generally along line 7-7 in FIG. 4. In one embodiment of the present invention, base plate 19 is a one-inch thick steel plate that is bolted to the floor by mounting bolts 39. Base plate 19 supports cylinder-mounting bracket 40. The bottom end of cylinder/piston 20 is pivotably mounted to cylinder-mounting bracket 40 and the piston arm 37 is attached to first section 28A of snubber arm 28 by cylinder-mounting clevis 41. Support post 27 is mounted to base plate 19 proximate cylinder mounting bracket 40.

Figure 6:
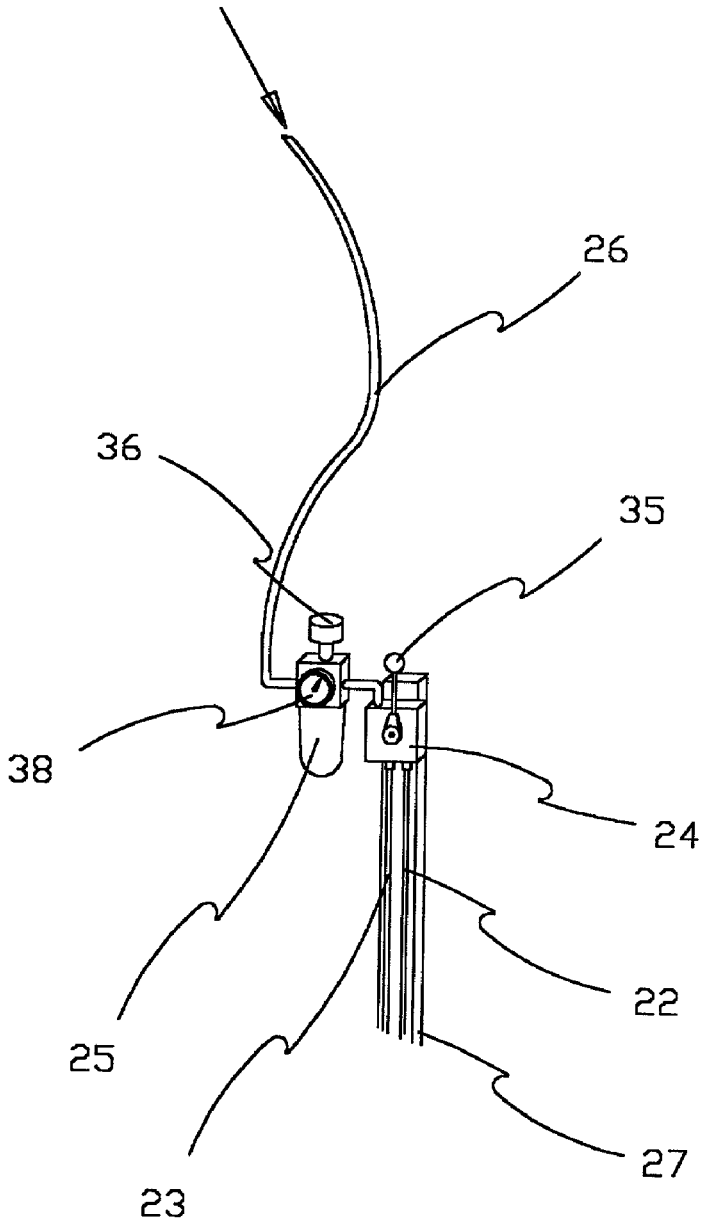
FIG. 6 is an enlarged perspective view of the filter regulator and air control valve taken generally along line 6-6 in FIG. 4.

FIG. 6 is an enlarged perspective view of filter regulator 25 and air control valve 24 taken generally along line 6-6 in FIG. 4. A preferred embodiment of the present invention comprises a floor-mounted coil reel hold down device operated by a shop air supply (approximately 90 psi). The air is delivered from main air supply hose 26 into filter regulator 25 (¼" NPT air FRL, "filter regulator lubricator") and is then controlled by operating valve handle 35. Operating valve handle 35 is supported by support post 27. The valve handle has two positions to control movement of the snubber arm. When operating valve handle 35 is actuated, it directs the air supply to cylinder air supply extend hose 22 causing snubber arm 28 to lower snubber wheel 30 into position onto coil reel 16. When operating valve handle 35 is deactivated, the air supply is directed to cylinder air supply retract hose 23 which releases the pressure the snubber arm has on coil reel 16. Air pressure is adjusted as to amount, degree or rate by pressure regulator adjustment knob 36 and monitored by pressure indicator 38.

Figure 8A:
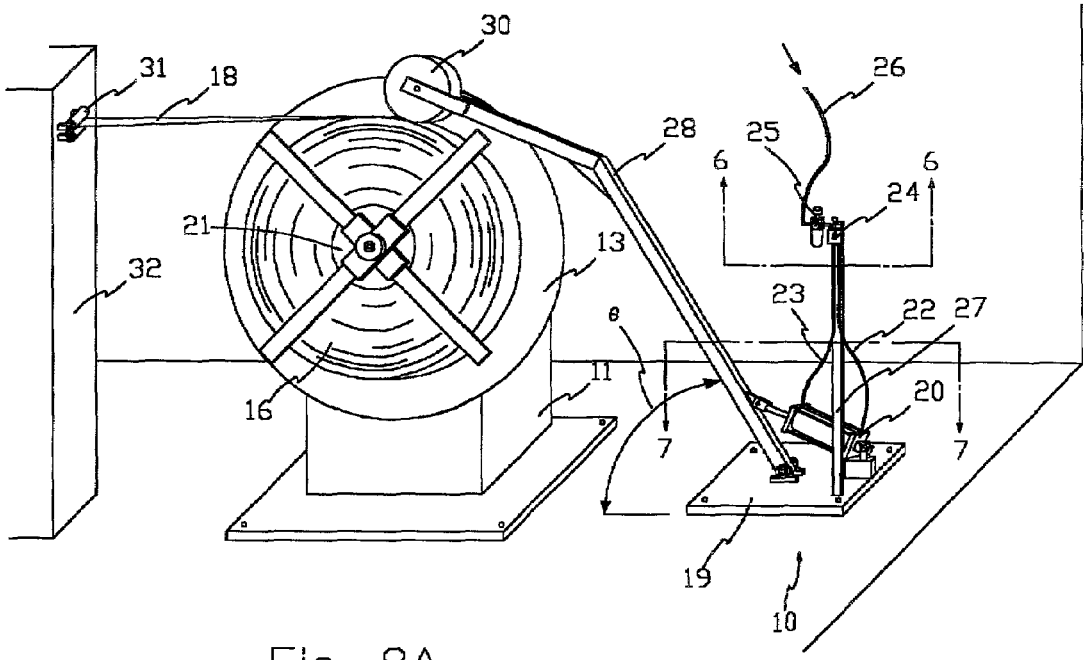
FIG. 8A is a perspective view of the present invention showing the snubber arm in place on a "large" diameter coil reel.
Figure 8B:
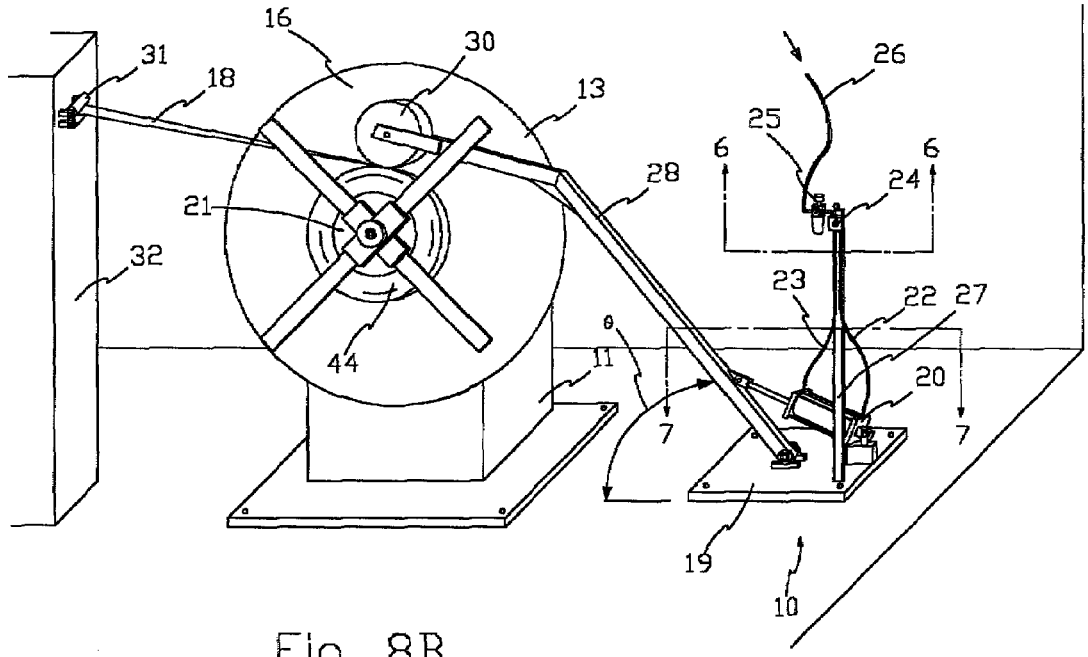
FIG. 8B is a perspective view of the present invention showing the snubber arm in place on a "small" diameter coil reel; and, FIG. 9 is a view of the snubber arm of the present invention, illustrating the various angles and lengths of the sections of the arm.

Coil reel hold-down device 10 is adapted to dispense different shaped coiled material from different sized coil reels (i.e., different diameters), such as wire and flat stock, as well as different thicknesses of material, including small to large gauge wire, as well as thick and thin flat stock. FIG. 8A is a perspective view of the coil reel hold down device of the invention depicting angle θ of snubber arm 28 with snubber wheel 30 pressed to "large diameter" unbounded coil reel 16 with a diameter of about 72". FIG. 8B is a perspective view of the coil reel hold down device depicting angle θ of snubber arm 28 with snubber wheel pressed to "small diameter" unbounded reel 44 with a diameter of about 24". FIG. 3 illustrates tilt angle θ of snubber arm 28 in the extreme up position. FIG. 8B depicts tilt angle θ of snubber arm 28 in the extreme "small-diameter" hold-down position. In this embodiment, snubber arm 28 has a continuous tilt angle range of about 40 degrees measured from the extreme up position to the extreme down position.

Figure 9:
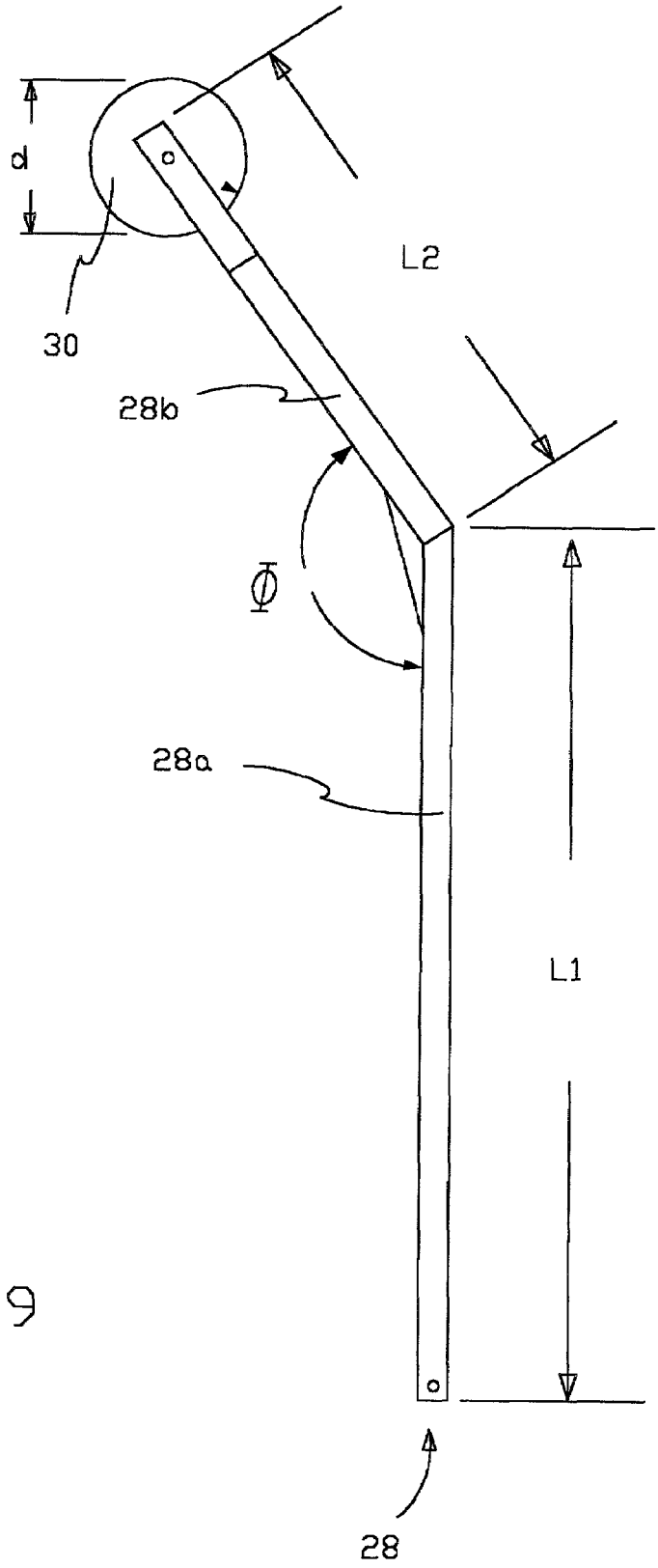

In the preferred embodiment, as depicted in FIG. 9, snubber arm 28 comprises a metal arm having a total length of about 72", including a first section 28A of 54" and a second section 24B of about 18". Other dimensions of the preferred embodiment are as follows: 1) the snubber wheel, a diameter of about 8"; 2) angle Φ) of snubber arm 28 is in the range of 100 to 130 degrees; 3) angle θ pivots about the axis from the point of connection of the snubber arm to the base plate with a variance of about 25 to 40 degrees. The dimensions provided above are for reference purposes only. It should be understood other combinations of dimensions are also possible.

As will be appreciated, the present invention provides an easy means of using existing stand-alone coil machines. The invention overcomes some of the deficiencies in the prior art by allowing safe operation of the machine without the release of tension and by eliminating the need for purchasing an entirely new machine.

What is claimed is:

1. A free-standing coil reel hold-down device, comprising:

a base plate operatively arranged to be secured to a floor;

a snubber arm having integral first and second sections arranged at an obtuse angle to one another, said snubber arm pivotably mounted to said base plate at a first end of said first section of said snubber arm and arranged for pivoting rotation about a pivot point proximate said base plate; and, an actuator mounted to said base plate, and arranged to effect a pivoting movement of said snubber arm relative to said base plate, wherein said actuator is connected to said first section of said snubber arm between said pivot point and said second section of said snubber arm.

2. The coil reel hold-down device recited in claim 1 wherein said first section of said snubber arm is disposed proximate said base plate.

3. The coil reel hold-down device recited in claim 1 further including a snubber device mounted to said second section of said snubber arm.

4. The coil reel hold-down device recited in claim 3 wherein said snubber device comprises a wheel.

5. The coil reel hold-down device recited in claim 3 wherein said snubber device comprises a roller.

6. The coil reel hold-down device recited in claim 1 wherein said obtuse angle is approximately 120 degrees.

7. The coil reel hold-down device recited in claim 1 wherein said first section has a first length and said second section has a second length wherein said first length is approximately three times said second length.

8. The coil reel hold down device recited in claim 1 wherein said obtuse angle is in a range of about 100 to 130 degrees.

9. The coil reel hold down device recited in claim 1 wherein said snubber arm is arranged to pivot about said pivot point through an angle in a range of approximately 25 to 40 degrees.

* * * * *